US007223917B1

(12) United States Patent
Marszalek et al.

(10) Patent No.: US 7,223,917 B1
(45) Date of Patent: May 29, 2007

(54) CONNECTOR, SYSTEM AND METHOD FOR CONNECTING CABLES

(75) Inventors: Christopher Marszalek, Plainfield, IL (US); Daniel Horvath, Plainfield, IL (US); Frank Harwath, Chicago, IL (US)

(73) Assignee: Sennco Solutions, Inc, Plainfield, IL (US)

( * ) Notice: Subject to any disclaimer, the term of this patent is extended or adjusted under 35 U.S.C. 154(b) by 0 days.

(21) Appl. No.: 11/293,896

(22) Filed: Dec. 5, 2005

(51) Int. Cl.
*H01R 4/00* (2006.01)
*H01R 13/627* (2006.01)

(52) U.S. Cl. ..... 174/84 R; 439/350

(58) Field of Classification Search ..... 174/84 R, 174/84 S; 439/350, 371
See application file for complete search history.

(56) References Cited

U.S. PATENT DOCUMENTS 4,627,490 A * 12/1986 Moore ..... 166/65.1
5,620,330 A * 4/1997 Pizon ..... 439/350
6,447,323 B1 * 9/2002 Watanabe ..... 439/371

* cited by examiner

*Primary Examiner*—Chau N. Nguyen
(74) *Attorney, Agent, or Firm*—Patents + TMS, P.C.

(57) ABSTRACT

A connector, a system and a method connect, attach and/or connect a first cable and a second cable via the connector. The connector has a finger and/or a receiver attached to and/or connected to the first cable and/or the second cable, respectively. The finger is insertable into the receiver to attach and/or to connect the first cable to the second cable. The finger has a projection to transmit, to communicate and/or to transfer an electrical signal between the first cable and the receiver. The receiver has a receptor for transmitting, for communicating and/or for transferring the electrical signal between the projection of the finger and the second cable. The finger and/or the projection of the first cable rotates and/or turns in a clockwise direction or a counter-clockwise direction with respect to the receiver of the second cable. The electrical signal is continuously transmitted, transferred and/or communicated between the first cable and the second cable as the finger turns and/or moves with respect to the receiver via the projection and/or the receiver.

20 Claims, 3 Drawing Sheets

CONNECTOR, SYSTEM AND METHOD FOR CONNECTING CABLES

BACKGROUND OF THE INVENTION

The present invention generally relates to a connector, a system and a method for connecting cables. More specifically, the present invention relates to a connector, a system and a method for connecting a first security cable and a second security cable. The connector, the first security cable and/or the second security cable may connect and/or may secure a portable electrical device to a power supply system and/or to an alarm system. An end of the first security cable may rotate and/or may turn in a clockwise direction or a counter-clockwise direction with respect to an end of the second security cable via the connector. The connector may have a finger attached to the end of the first security cable and/or a receiver attached to the end of the second security cable. The finger may be insertable into the receiver to attach and/or to connect the first security cable to the second security cable. A conductor of the finger may contact a receptor of the receiver to transmit, to communicate and/or to transfer an electrical signal between the first security cable and the second security cable.

It is generally known to display a portable electronic device, for example, in a store or other venue for sale to a purchaser. Typically, the portable electronic device is displayed in conjunction with a fixture, such as, a table, a shelf or a rack. The electronic device is connected to and/or attached to the fixture and/or to a network with a security cable. The network provides a voltage to and/or a current to the electronic device via the security cable. The network transmits and/or receives signals corresponding to video images and/or audio signals from the electronic device via the security cable. Further, the security cable electrically secures and/or mechanically secures the electronic device to the alarm system and/or the fixture, respectively.

However, the security cable which secures the device often prevents a customer and/or a user from manipulating and/or from examining the device. The device is often fixed to a surface of the fixture or the security cable for attaching the device to the fixture. The security cable may have a length which is not adjustable. Accordingly, the purchaser is unable to lift and/or to move the device to examine characteristics of the device, such as, for example, a weight, a texture, a contour, a configuration of the device and/or the like. A security cable with a longer length may be incorporated with the device and/or the fixture to allow the purchaser to examine the device. However, a longer security cable may be impractical, may restrict movement of the device and/or may tangle with other cables and/or the device or other devices.

A need, therefore, exists for a connector, a system and a method for connecting cables. Further, a need exists for a connector, a system and a method for connecting cables which may secure, may connect and/or may attach a first security cable to a second security cable. Still further, a need exists for a connector, a system and a method for connecting cables which may electrically connect and/or may mechanically attach a first security cable and/or a second security cable. Moreover, a need exists for a connector, a system and a method for connecting cables which may have a finger insertable into a receiver to connect and/or to attach a first security cable and a second security cable. Furthermore, a need exists for a connector, a system and a method for connecting cables which may rotate, may swivel and/or may turn the finger of a first security cable in a clockwise direction or in a counter-clockwise direction with respect to the receiver of a second security cable.

SUMMARY OF THE INVENTION

The present invention generally relates to a connector, a system and a method for connecting cables. More specifically, the present invention relates to a connector, a system and a method for connecting cables which may have a first security cable attached to and/or connected to a second security cable via the connector. The first security cable may have a finger insertable into a receiver for connecting the first security cable and the second security cable. The first security cable may be electronically connected to and/or mechanically attached to the second security cable via the connector. The finger may have a conductor and/or a projection to transmit, to communicate and/or to transfer an electrical signal to a receptor of the receiver. A clip may be insertable into a slot of the receiver to secure and/or to attach the finger to the receiver. The finger may swivel, may turn, may move and/or may rotate in a clockwise direction or in a counter-clockwise direction with respect to the receiver.

To this end, in an embodiment of the present invention, a connector for connecting a first cable to a second cable is provided. The connector has a finger having an exterior surface and a length wherein the length is defined between a first end a second end wherein the first end has a base wherein the second end has a conductor and further wherein the conductor is electrically connected to the first cable. Moreover, the connector has a receiver having an interior and an exterior surface wherein the receiver has a length wherein the length is defined between a first end and a second end wherein the receiver has a receptor wherein the receptor is electrically connected to the second cable wherein the interior of the receiver receives the finger wherein the conductor of the finger abuts the receptor of the receiver and further wherein the finger rotates with respect to the receiver and the conductor is electrically connected to the receptor.

In an embodiment, the first cable is electrically connected to the second cable.

In an embodiment, the connector has a slot in the receiver extending through the receiver from the interior of the receiver to the exterior surface of the receiver.

In an embodiment, the connector has a clip connecting to the receiver and the second cable.

In an embodiment, the connector has a rib attached to the interior of the receiver wherein the rib extends outward with respect to the interior of the receiver.

In an embodiment, the connector has a groove on the exterior surface of the receiver wherein the groove extends inward with respect to the exterior surface of the receiver.

In an embodiment, the connector has a groove on the exterior surface of the finger wherein the groove extends inward with respect to the exterior surface of the finger.

In another embodiment of the present invention, a system for connecting a first cable to a second cable is provided. The system has a finger having an exterior surface and a length wherein the length is defined between a first end and a second end wherein the first end has a base wherein the base is attached to an end of the first cable. Further, the system has a projection connected to the finger wherein the projection extends outward with respect to the exterior of the finger wherein the projection is electrically connected to the first cable. Still further, the system has a base having an interior and an exterior surface wherein the base has a length wherein the length is defined between a first end and a second end wherein the second end of the base is attached to an end of the second cable. Moreover, the system has a receptor electrically connected to the second cable wherein the receptor is insertable into the interior of the base wherein the interior of base receives the finger wherein the projection abuts the receptor wherein the finger rotates with respect to the base and further wherein the receptor is electrically connected to the projection.

In an embodiment, the first end of the base is a clip.

In an embodiment, the first cable is electrically connected to the second cable.

In an embodiment, the system has a compartment is inserted between the receptor to the base wherein the receptor is attached to the compartment.

In an embodiment, the system has an opening in the base extending through the base from the interior to the exterior surface.

In an embodiment, the system has a groove on the exterior surface of the finger extending inward with respect to the exterior surface of the finger.

In another embodiment of the present invention, a method for connecting a first cable to a second cable wherein an end of the first cable is adjacent to an end of the second cable is provided. The method has the step of providing a finger having an exterior surface and a length wherein the length is defined between a first end and a second end wherein the first end has a base and further wherein the finger has a projection extending outward with respect to exterior surface of the finger. Further, the method has the step of providing a receiver having an interior, an exterior surface and a length wherein the length is defined between a first end and a second end. Still further, the method has the step of connecting a receptor to the interior of the receiver. Moreover, the method has the step of inserting the finger into the interior of the receiver. Furthermore, the method has the step of rotating the finger with respect to the receiver wherein the projection is electrically connected to the receiver.

In an embodiment, the method has the step of electrically connecting the projection or the receptor to the first cable or the second cable.

In an embodiment, the first cable is electrically connected to the second cable.

In an embodiment, the method has the step of inserting the receiver into a base attached to the second cable.

In an embodiment, the method has the step of transmitting an electrical signal between the projection and the receptor.

In an embodiment, the method has the step of forming a groove on the exterior of the finger wherein the groove extends inward with respect to the exterior of the finger.

In an embodiment, the method has the step of rotating the end of the second cable with respect to the end of the first cable.

It is, therefore, an advantage of the present invention to provide a connector, a system and a method for connecting cables which may attach a first security cable to a second security cable via the connector.

Another advantage of the present invention is to provide a connector, a system and a method for connecting cables which may electronically connect and/or may mechanically attach a first security cable to a second security cable.

Yet another advantage of the present invention is to provide a connector, a system and a method for connecting cables which may have a finger of a first security cable insertable into a receiver of a second security cable.

Moreover, an advantage of the present invention is to provide a connector, a system and a method for connecting cables which may move, may rotate, may turn and/or may swivel an end of a first security cable and/or a finger in a clockwise direction or a counter-clockwise direction with respect to an end of a second security cable and/or a receiver.

Further, an advantage of the present invention is to provide a connector, a system and a method for connecting cables which may have a projection and/or a receptor for transmitting, for communicating and/or for transferring an electrical signal between a first security cable and a second security cable.

Still further, an advantage of the present invention is to provide a connector, a system and a method for connecting cables which may have a conductor, a receptor, a clip, a rib and/or a projection to electronically secure or to mechanically attach a first security cable to a second security cable.

And, an advantage of the present invention is to provide a connector, a system and a method for connecting cables which may not prevent a user from moving, from lifting and/or from examining a device attached to security cables without tangling of, without crimping of and/or without restriction from the security cables.

Yet another advantage of the present invention is to provide a connector, a system and a method for connecting cables which may continuously transfer an electrical signal between a first security cable and/or a second security cable as an end of the first security cable rotates in a clockwise direction or a counter-clockwise direction with respect to an end of the second security cable.

Another advantage of the present invention is to provide a connector, a system and a method for connecting cables which may prevent tangling of and/or damage to the cables by rotating an end of a first security cable in a clockwise direction and/or a counter-clockwise direction with respect to an end of a second security cable.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a connector, a system and a method for connecting cables. More specifically, the present invention relates to a connector, a system and a method for connecting cables which may attach and may connect a first security cable and a second security cable via the connector. The connector may have a finger and/or a receiver which may be attached to and/or may be connected to an end of the first security cable and/or the second security cable, respectively. The finger may be insertable into the receiver to connect and/or to attach the first security cable and the second security cable. The finger may have projections to transmit, to communicate and/or to transfer an electrical signal between the first security cable and the second security cable. The receiver may have receptors for transmitting, for communicating and/or for transferring the electrical signal between the projections of the finger and the receiver. The finger and/or the projections may move, may rotate, may turn and/or may swivel in a clockwise direction or in a counter-clockwise direction with respect to the receiver and/or the receptors.

Figure 1:
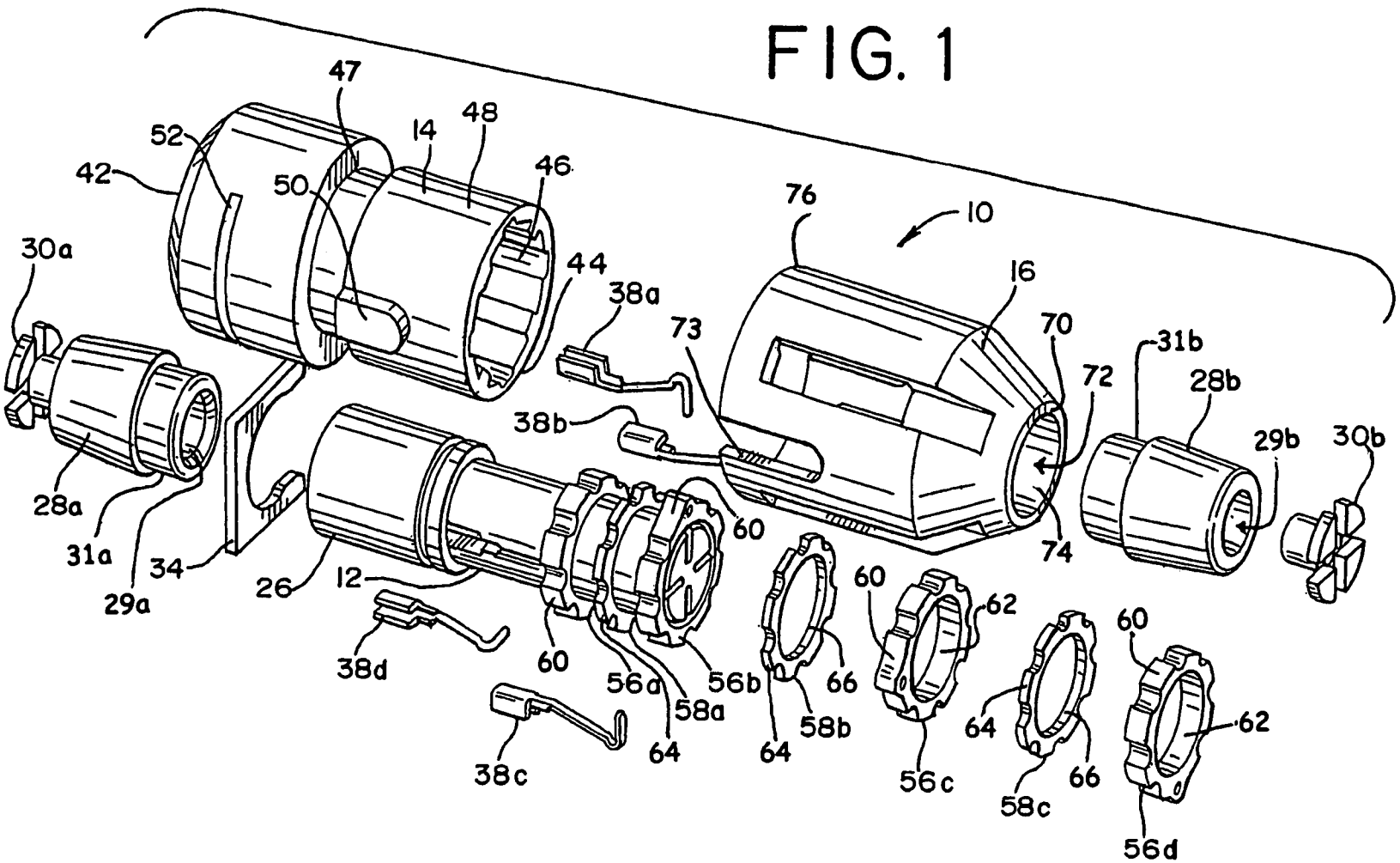
FIG. 1 illustrates an exploded perspective view of a connector in an embodiment of the present invention.
Figure 4:
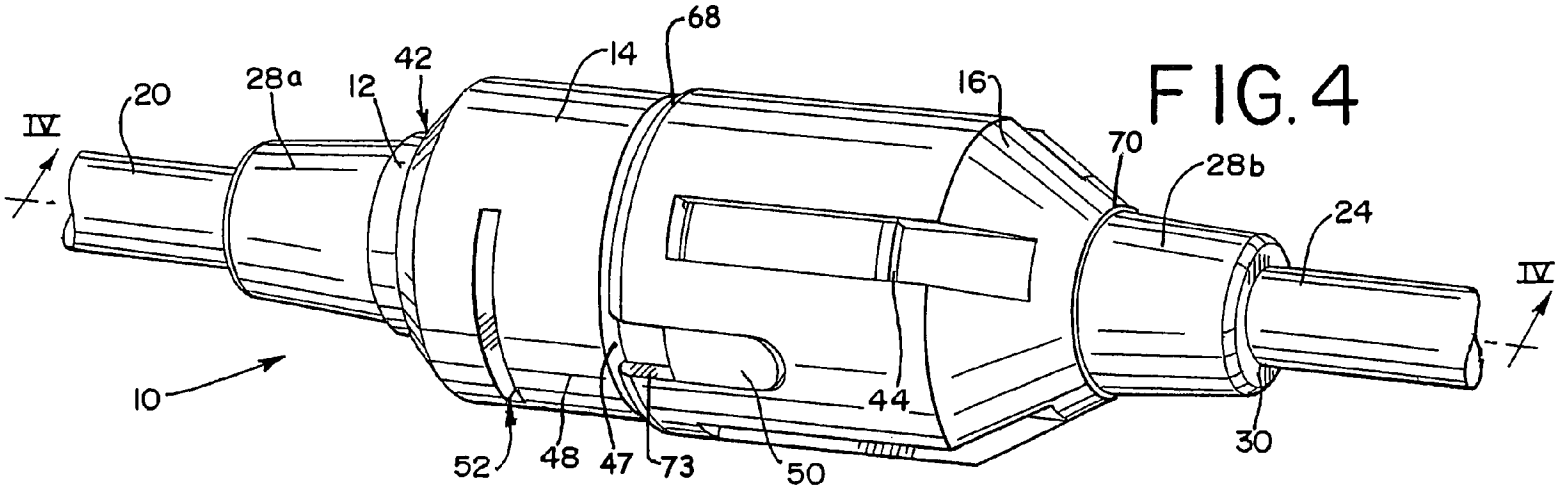
FIG. 4 illustrates a perspective view of a first security cable attached to a second security cable via a connector in another embodiment of the present invention.
Figure 5:
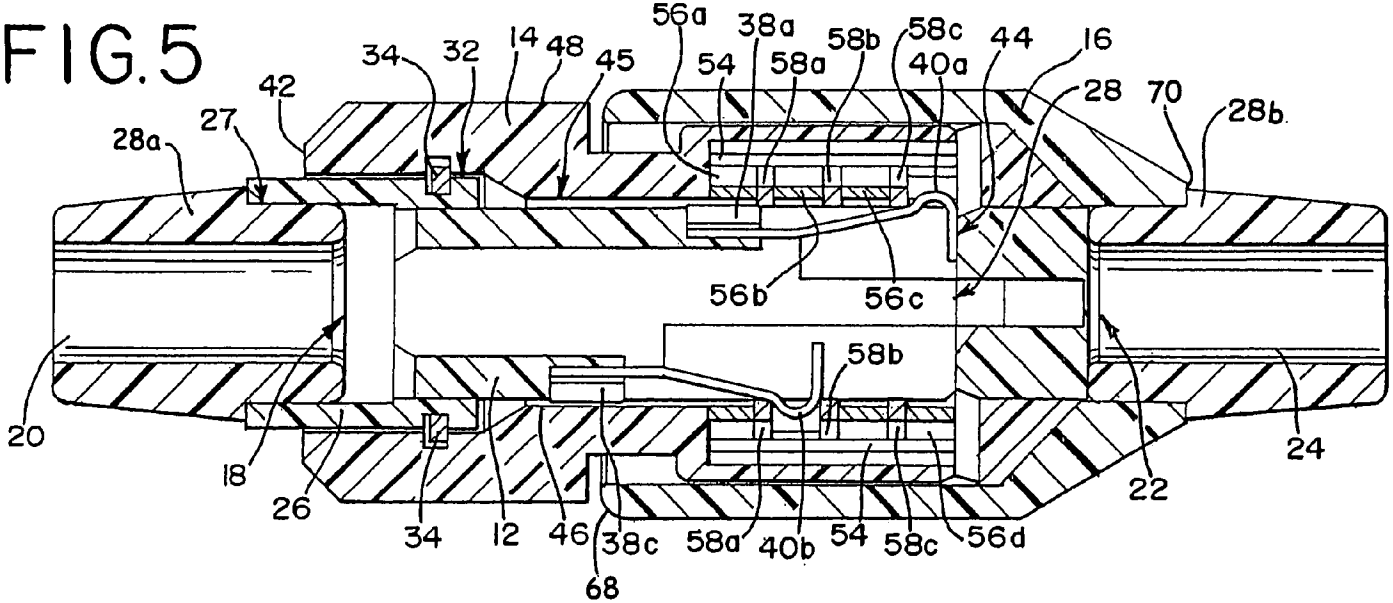
FIG. 5 illustrates a cross-sectional view of the first security cable attached to the second security cable via the connector in FIG. 4 as taken along line IV—IV in an embodiment of the present invention.

Referring now to the drawings wherein like numerals refer to like parts, FIGS. 1, 4 and 5 illustrate a connector 10 in an embodiment of the present invention. The connector 10 may have a finger 12, a receiver 14 and/or a base 16. The finger 12 may be connected to and/or may be attached to an end 18 of a first security cable 20. The base 16 may be connected to and/or may be attached to an end 22 of a second security cable 24. The finger 12 may be insertable into and/or may be attached to the receiver 14 for connecting the first security cable 20 to the receiver 14. The receiver 14 may be insertable into and/or may be attached to the base 16 for connecting the first security cable 20 to the base 16. As a result, the first security cable 20 may be connected to, may be attached to, may be secured to and/or may be coupled to the second security cable 24 via the finger 12, the receiver 14 and/or the base 16 of the connector 10.

An electrical signal may be transmitted, may be communicated and/or may be transferred between the first security cable 20 and the second security cable 24 via the connector 10. The electrical signal may be transferred, may be communicated and/or may be transmitted between the end 18 of the first security cable 20 and the end 22 of the second security cable 24 via the finger 12, the receiver 14 and/or the base 16 of the connector 10. The electrical signal may be transmitted, may be communicated and/or may be transmitted from the end 22 through the second security cable 24 to a portable electronic device (not shown in the figures) which may be connected and/or may be attached to the second security cable 24. The portable electronic device may be, for example, a camera, a camcorder, a digital camera, a digital music player, a video game, a digital video player, a digital video recorder, a personal data assistant (hereinafter "a PDA"), a cellular telephone and/or the like. The present invention should not be deemed as limited to a specific embodiment of the portable electronic device.

The electrical signal may be, for example, a signal capable of transmitting, of communicating and/or of transferring a current or a voltage between the first security cable 20 and/or the second security cable 24. Further, the electrical signal may be, for example, an analog signal or a digital signal which may transmit, for example, a video signal, audio signal and/or the like. Moreover, the electrical signal may be a communication signal between, for example, an alarm system, a power source and/or a micro-controller. The present invention should not be deemed as limited to a specific embodiment of the electrical signal. It should be understood that the electrical signal may be any electrical signal as known by one of ordinary skill in the art.

Figure 2:
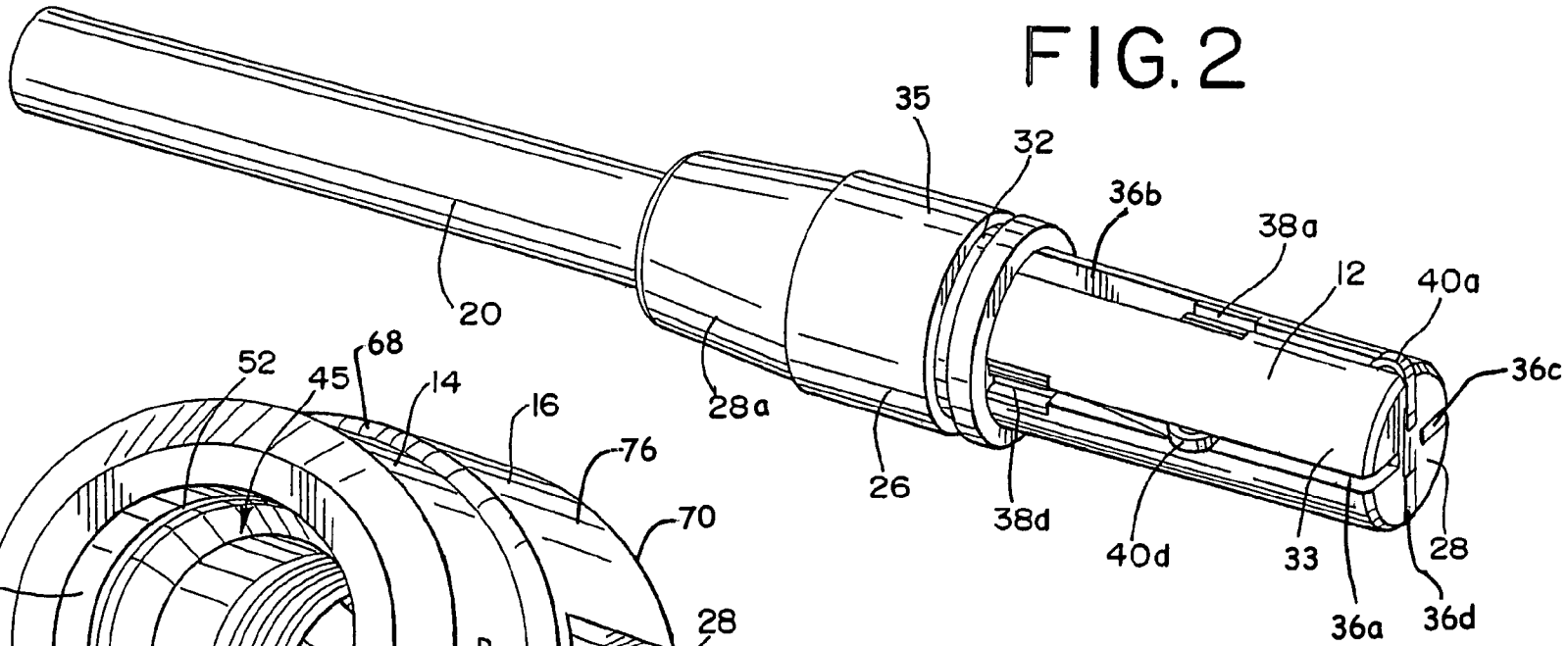
FIG. 2 illustrates a perspective view of a finger attached to an end of a first security cable in an embodiment of the present invention.

As shown in FIGS. 1, 2 and 5, the finger 12 may have a base 26 and/or a tip 28. The tip 28 is opposite to the base 26 of the finger 12. The base 26 of the finger 12 may be attached to and/or electrically connected to the end 18 of the first security cable 20. The base 26 may have an interior 27 for connecting to the end 18 of the first security cable 20. A cross-sectional shape of the base 26, the interior 27 of the base 26 and/or the finger 12 may be, for example, rounded and/or circular.

A head 31*a* of a housing 28*a* may be insertable into and/or may be secured to the interior 27 of the base 26. The housing 28*a* may have an interior 29*a* which may receive the end 18 of the first security cable 20. A cross-sectional shape of the head 31*a* or the housing 28*a* may be, for example, rounded and/or circular. The interior 27 of the base 26 may be sized and/or may be formed to receive the head 31*a* of the housing 28*a*. The head 31*a* of the housing 28*a* may be inserted into the interior 27 of the base 26. As a result, the housing 28*a* may be attached to the base 26 of the finger 12 to the end 18 of the first security cable 20. The housing 28*a* may cover the end 18 of the first security cable 20 to prevent separation of the end 18 of the first security cable 20 from the housing 28*a*.

A ring 30*a* may be insertable into and/or secured to the interior 29*a* of the housing 28*a*. The interior 29*a* of the housing 28*a* may be sized and/or may be formed to receive the ring 30*a*. The end 18 of the first security cable 20 may be inserted into and/or may extend through the ring 30*a* and/or the housing 28*a* to connect and/or to attach the first security cable 20 to the base 26 of the finger 12, the housing 28*a* and/or the ring 30*a*. As a result, the end 18 of the first security cable 20 may be attached and/or may be connected to the finger 12 via the base 26, the housing 28*a* and/or the ring 30*a*.

The finger 12 and/or the base 26 may be made from a material, such as, for example, a liquid crystal polymer and/or the like. The housing 28*a* may be made from a material, such as, for example, rubber, plastic, polyurethane, nitrile rubber and/or the like. The ring 30*a* may be made from a material, such as, for example, brass, copper, zinc, bronze and/or the like. The present invention should not be deemed as limited to a specific embodiment of the material of the finger 12, the housing 28*a* and/or the ring 30*a*. It should be understood that the material of the finger 12, the base 26, the housing 28*a* and/or the ring 30*a* may be any material as known by one of ordinary skill in the art.

The finger 12 and/or the base 26 may have an exterior surface 33 and/or an exterior surface 35, respectively, as shown in FIG. 2. The exterior surface 35 of the base 26 may have a groove 32 for receiving a clip 34. The exterior surface 33 of the finger 12 may have recessions 36*a*–36*d* for receiving conductors 38*a*–38*d*, respectively. The recessions 36*a*–36*d* may extend from the base 26 to the tip 28 of the finger 12. The conductors 38*a*–38*d* may have projections 40*a*–40*d*, respectively, for attaching and/or securing the finger 12 to the receiver 16 as illustrated in FIGS. 2 and 5. The projections 40*a*–40*d* may extend outward with respect to the exterior surface 33 of the finger 12. The projections 40*a*–40*d* may be, for example, rounded and/or circular. The electrical signal may be transmitted, may be communicated and/or may be transferred between the first security cable 20 and/or the conductors 38*a*–38*d* and/or the projections 40*a*–40*d*. The conductors 38*a*–38*d* and/or the projections 40*a*–40*d* may be inserted into, may be attached to, may be connected to and/or may be secured to the finger 12 via the recessions 36*a*–36*d* in the exterior 33. The conductors 38*a*–38*d* and/or the projections 40*a*–40*d* may be made from a material, such as, for example, nickel, copper, cobalt, bronze, brass and/or the like. The present invention should not be deemed as limited to a specific embodiment of the material of the conductors 38*a*–38*d* and/or the projections 40*a*–40*d*. It should be understood that the material of the conductors 38*a*–38*d* and/or the projections 40*a*–40*d* may be any material capable of transferring, communicating and/or transmitting the electrical signal as known by one of ordinary skill in the art.

Figure 3:
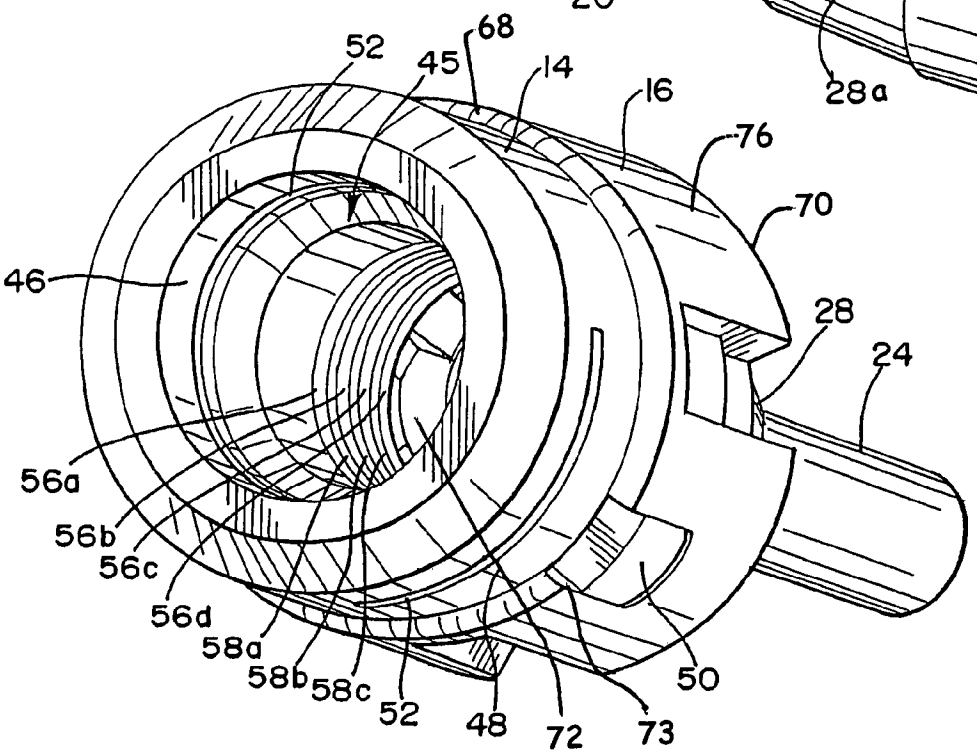
FIG. 3 illustrates a perspective view of a receiver and a base attached to an end of a second security cable in another embodiment of the present invention.

As illustrated in FIGS. 1 and 3–5, the receiver 14 may have a first end 42 and a second end 44. The second end 44 is opposite to the first end 42. The receiver 14 may have an interior 45, an interior surface 46 and an exterior surface 48 as shown in FIG. 3. The exterior surface 48 of the receiver 14 may have a groove 47 as shown in FIGS. 1 and 4. The receiver 14 may have a tab 50 which may extend outward with respect to the exterior surface 48. The tab 50 may be located between the groove 47 and the second end 44 of the receiver 15. The receiver 14 may have a slot 52 which may extend through the receiver 14 from the interior surface 46 to the exterior surface 48. The slot 52 may be located between the groove 47 and the first end 42 of the receiver 14. The slot 52 may be sized and/or may be formed to receive the clip 34 for attaching and/or to securing the finger 12 within the interior 45 of the receiver 14. The receiver 14 may be made from a material, such as, for example, thermoplastic polyester resin, polybutylene terephthalate polymer and/or the like. The present invention should not be deemed as limited to a specific embodiment of the material of the receiver 14. It should be understood that the material of the receiver 14 may be any material as known by one of ordinary skill in the art.

The interior 45 of the receiver 14 may have a compartment 54 adjacent to the second end 44 of the receiver 14 as shown in FIG. 5. The compartment 54 may be located between the groove 32 and the second end 44 of the receiver 14. A cross-sectional shape of the receiver 14, of the interior 45 and/or of the compartment 54 may be, for example, rounded and/or circular. The interior surface 46 of the compartment 54 may be sized and/or may be formed to receive the receptors 56*a*–56*d* and/or the ribs 58*a*–58*c* as illustrated in FIGS. 3 and 5. The receptors 56*a*–56*d* may have an exterior surface 60 and/or an interior surface 62 as shown in FIG. 1. The ribs 58*a*–58*c* may have an exterior surface 64 and/or an interior surface 66.

The interior surfaces 46, 62, 66 of the receiver 14, the receptors 56*a*–56*d* and/or the ribs 58*a*–58*c*, respectively, may correspond to the exterior surfaces 33, 35 of the finger 12 and/or the base 26, respectively. The receptors 56*a*–56*d* and/or the ribs 58*a*–58*c* may be inserted into the compartment 54 to attach the receptors 56*a*–56*d* and/or the ribs 58*a*–58*c* to the receiver 14. The interior surface 46 of the compartment 54 may abut and/or may contact the exterior surfaces 60, 64 of the receptors 56*a*–56*d* and/or the ribs 58*a*–58*c*. As a result, the receptors 56*a*–56*d* and/or the ribs 58*a*–58*c* may be connected to, may be attached to and/or may be secured to the compartment 54 of the receiver 14. Each of the receptors 56*a*–56*d* may be separated by one of the ribs 58*a*–58*c*. For example, the rib 58*a* may be located between the receptors 56*a*, 56*b*. Further, the rib 58*b* may be located between the receptors 56*b*, 56*c*. Still further, the rib 58*c* may be located between the receptors 56*c*, 56*d*.

The receptors 56*a*–56*d* and/or the ribs 58*a*–58*c* may transmit, may communicate and/or may transfer the electrical signal. The receptors 56*a*–56*d* may be made from a material, such as, for example, brass, bronze, gold, cobalt, nickel, copper and/or the like. The ribs 58*a*–58*c* may be made from a material, such as, for example, delrin acetal, an acetal resin plastic and/or the like. The present invention should not be deemed as limited to a specific embodiment of the material of the receptors 56*a*–56*d* and/or the ribs 58*a*–58*c*. It should be understood that the material of the receptors 56*a*–56*d* and/or the ribs 58*a*–58*c* may be any material which may transmit, may communicate and/or may transfer the electrical signal as known by one of ordinary skill in the art.

The interior 45 of the receiver 14 and/or the compartment 54 may be sized and/or may be formed to receive the finger 12 and/or the projections 40*a*–40*d*. The finger 12 may be inserted into the interior 45 of the receiver 14 and/or the compartment 54. The interior surface 46 of the receiver 14 and/or the compartment 54 may be sized and/or may be formed to receive, to contact, to correspond to and/or to abut the projections 40*a*–40*d* and/or exterior surfaces 33, 35 of the finger 12 and/or the base 26, respectively. As a result, the projections 40*a*–40*d* and/or exterior surfaces 33, 35 of the base 26 and/or the finger 12 may abut the interior surfaces 45, 62, 66 of the receiver 14, the receptors 56*a*–56*d* and/or the ribs 58*a*–58*c*, respectively.

The base 26 of the finger 12 may be adjacent to and/or may abut the first end 42 of the receiver 14. The tip 28 of the finger 12 may be adjacent to and/or may abut the second end 44 of the receiver 14. The projections 40*a*–40*d* may abut the receptors 56*a*–56*d* and/or the ribs 58*a*–58*c*. As a result, the finger 12 may be attached to, may be connected to and/or may be secured to the receiver 14 via the projections 40*a*–40*d*, the receptors 56*a*–56*d* and/or the ribs 58*a*–58*c*.

Each of the connectors 40*a*–40*d* may be sized to contact and/or to abut one of the receptors 56*a*–56*d*. For example, the projection 40*a* may contact, may be connected to and/or may abut the receptor 56*a*. As a result, the electrical signal may be transmitted, may be communicated and/or may be transferred from the projection 40*a* and/or the receptor 56*a*. Further, the projection 40*b* may contact, may be connected to and/or may abut the receptor 56*b*. As a result, the electrical signal may be transmitted, may be communicated and/or may be transferred from the projection 40*b* and/or the receptor 56*b*. Still further, the projection 40*c* may contact, may be connected to and/or may abut the receptor 56*c*. As a result, the electrical signal may be transmitted, may be communicated and/or may be transferred from the projection 40*c* and/or the receptor 56*c*. Moreover, the projection 40*d* may contact, may be connected to and/or may abut the receptor 56*d*. As a result, the electrical signal may be transmitted, may be communicated and/or may be transferred from the projection 40*d* and/or the receptor 56*d*.

The slot 52 of the receiver 14 may be aligned with and/or may be adjacent to the groove 32 in the exterior surface 35 of the base 26 of the finger 12. The clip 34 may be inserted into the slot 52 of the receiver 14 and/or the groove 32 of the exterior surface 35 of the base 26. The clip 34 may be sized to and/or may be formed to secure, to connect and/or to attach the finger 12 to the receiver 14 via the slot 52 and/or the groove 32. As a result, the finger 12 may be connected to, may be attached to and/or may be secured to the receiver 14 via the clip 34. The clip 34 may be, for example, generally U-shaped and may be may be made from a material, such as, for example, steel, iron, copper and/or the like. The present invention should not be deemed as limited to a specific embodiment of the material of the clip 34. It should be understood that the material of the clip 34 may be any material as known by one of ordinary skill in the art.

As shown in FIGS. 1 and 3–5, the base 16 may have a clip 68 and/or a first end 70. The clip 68 is opposite to the first end 70 of the base 16. The first end 70 of the base 16 may be attached to and/or may be connected to the end 22 of the second security cable 24. The base 16 may have an interior 72, an interior surface 74 and/or an exterior surface 76. The interior 72 and/or the interior surface 74 may connect to, may attach to and/or may receive the end 22 of the first security cable 24 as shown in FIG. 5. As a result, the base 16 may be attached to and/or may be connected to the second security cable 24. A cross-sectional shape of the base 16 and/or the interior 72 of the base 16 may be, for example, rounded and/or circular. The base 16 may be made from a material, such as, for example, thermoplastic polyester resin, polybutylene terephthalate polymer and/or the like. The present invention should not be deemed as limited to a specific embodiment of the material of the base 16. It should be understood that the material of the base 16 may be any material as known by one of ordinary skill in the art.

A head 31*b* of a housing 28*b* may be insertable into and/or may be secured to the interior 72 of the base 16 as shown in FIG. 1. The housing 28*b* may have an interior 29*b* which may receive the end 22 of the second security cable 24. A cross-sectional shape of the head 31*b* or the housing 28*b* may be, for example, rounded and/or circular. The interior 72 of the base 16 may be sized and/or may be formed to receive the head 31*b* of the housing 28*b*. The housing 28*b* may be attached to the base 16 to the end 22 of the second security cable 24. The housing 28*b* may cover the end 22 of the second security cable 24 to prevent separation of the end 22 of the second security cable 24 from the housing 28*b*. The head 31*b* may be inserted into the interior 72 of the base 16.

A ring 30*b* may be insertable into and/or secured to the interior 29*b* of the housing 28*b*. The interior 29*b* of the housing 28*b* may be sized and/or may be formed to receive the ring 30*b*. The ring 30*b* may be inserted into, may be attached to and/or may be connected to the housing 28*b*. The end 22 of the second security cable 24 may be inserted into and/or may extend through the ring 30*b* for connecting and/or for attaching the second security cable 24 to the base 16, the housing 28*b* and/or the ring 30*b*. As a result, the end 22 of the second security cable 24 may be attached to and/or may be secured to the base 16, the housing 28*b* and/or the ring 30*b*.

The base 16 may have an opening 73 for receiving the tab 50 of the receiver 14. The opening 73 may extend from the interior surface 74 to the exterior surface 76. The interior 72 and/or the interior surface 74 may be sized and/or may be formed to receive the receiver 14. The interior surface 74 of the base 16 may correspond to the exterior surface 48 of the receiver 14. The receiver 14 may be inserted into the interior 72 of the base 16. The clip 68 of the base 16 may align with and/or may be inserted into the groove 47 of the receiver 14. As a result, the receiver 14 may be attached to and/or may be connected to the base 16 via the clip 68. The tab 50 of the receiver 14 may be aligned with and/or may be inserted into the opening 73 of the base 16. As a result, the receiver 14 may be attached to and/or may be connected to the base 16 via the tab 50 and/or the opening 73. The second end 44 of the receiver 14 may be adjacent to and/or may abut the first end 70 and/or the exterior surface 76 of the base 16. As a result, the receiver 14, the finger 12 and/or the first security cable 18 may be attached to, may be connected to and/or may be secured to the base 16 via the tab 50 of the receiver 14 and/or the clip 68 and/or the opening 76 of the base 16.

The receptors 56*a*–56*d* may be electrically connected and/or may be attached to the end 22 of the second security cable 24. The receptors 56*a*–56*d* may transmit, may communicate and/or may transfer the electrical signal to the end 22 of the second security cable 24. As a result, the electrical signal may be transmitted, may be communicated and/or may be transferred from the first security cable 18 to the second security cable 24 via the finger 12, the receiver 14 and/or the base 16. The first security cable 20 may be mechanically attached to the second security cable 24 via the clip 34, the tab 50 and/or the clip 68. The first security cable 20 may be electrically connected to the second security cable 24 via the conductors 38*a*–38*d*, the projections 40*a*–40*d* and/or the receptors 40*a*. The second security cable 24 may be connected to, may be attached to and/or may be in communication with the portable electronic device. As a result, the electrical signal may be transferred, may be transmitted and/or may be communicated between the portable electronic device, the first security cable 18, the finger 12, the receiver 14, the base 16 and/or the second security cable 24.

The interior surface 46 and/or the interior 45 of the receiver 14 may be configured, may be sized and/or may be formed to rotate, to swivel and/or to turn the finger 12 in a direction, such as, for example, a clockwise direction and/or a counter-clockwise direction with respect to the receiver 14. As a result, the finger 12, the conductors 38*a*–38*d* and/or the projections 40*a*–40*b* may rotate, may swivel and/or may turn in the direction with respect to the receiver 14 and/or the end 22 of the second security cable 24. The finger 12 and/or the end 18 of the first security cable 20 may rotate, may swivel and/or may turn in the direction with respect to the base 16 and/or the end 22 of the second security cable 24. As a result, rotating and/or turning the first security cable 20 in the direction with respect to the second security cable 24 may prevent the security cable 20, 24 from tangling, from twisting and/or from crimping with each other.

The receptors 56*a*–56*d* and/or the ribs 58*a*–58*c* may be configured and/or may be sized for the projections 40*a*–40*b* to contact and/or to abut the receptors 56*a*–56*d* and/or the ribs 58*a*–58*c* as the finger 12 may rotate, may swivel, may move and/or may turn in the direction with respect to the receiver 14. The projections 40*a*–40*b* may contact and/or may abut the receptors 58*a*–58*d* and/or the ribs 56*a*–56*c* as the finger 12 may rotate, may swivel, may turn and/or may move in the direction with respect to the receiver 14. The electrical signal may be transmitted, may be communicated and/or may be transferred from the projections 40*a*–40*d* to the receptors 56*a*–56*d* as the finger 12 may rotate and/or may turn in the direction with respect to the receiver 14. The electrical signal may be continuously transmitted, communicated and/or transferred from the projections 40*a*–40*d* to the receptors 56*a*–56*d* as the finger 12 may rotate and/or may turn in the direction with respect to the receiver 14. The electrical signal may be continuously transmitted, communicated and/or may be transferred from the first security cable 10 to the second security cable 24. As a result, the security cables 20, 24 may be mechanically attached and/or electrically connected as the first security cable 20 may rotate and/or may turn in the direction with respect to the second security cable 24.

The connector 10 may attach, may connect and/or may couple the first security cable 20 and the second security cable 24. The connector 10 may have the finger 12 and/or the receiver 14 which may be attached to and/or may be connected to the ends 18, 22 of the first security cable and/or the second security cable 24, respectively. The finger 12 may be insertable into the receiver 14 to connect the first security cable 20 and the second security cable 24. The finger 12 may have the conductors 38*a*–38*d* and/or may have the projections 40*a*–40*d* to transmit, to communicate and/or to transfer an electrical signal between the first security cable 20 and the second security cable 20. The receiver 14 may have the receptors 56*a*–56*d* for transmitting, for communicating and/or for transferring the electrical signal to and/or from the conductors 38*a*–38*d* and/or the projections 40*a*–40*d* of the finger 12. The finger 12 may move, may rotate, may turn and/or may swivel in a clockwise direction or a counter-clockwise direction with respect to the receiver 14.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A connector for connecting a first cable to a second cable, the connector comprising:

a finger having an exterior surface and a length wherein the length is defined between a first end and a second end wherein the first end has a base having an exterior surface wherein the exterior surface of the finger has a recession wherein the recession extends longitudinally along the exterior surface of the finger from the base to the second end of the finger wherein the recession has a conductor at the second end of the finger and further wherein the conductor is electrically connected to the first cable; and a receiver having an interior and an exterior surface wherein the receiver has a length wherein the length is defined between a first end and a second end wherein the receiver has a receptor wherein the receptor is electrically connected to the second cable wherein the interior of the receiver receives the finger wherein the conductor of the finger abuts the receptor of the receiver and further wherein the finger rotates with respect to the receiver and the conductor is electrically connected to the receptor.

2. The connector of claim 1 wherein the first cable is electrically connected to the second cable.

3. The connector of claim 1 further comprising:

a slot in the receiver extending through the receiver from the interior of the receiver to the exterior surface of the receiver.

4. The connector of claim 1 further comprising:

a clip connecting to the receiver and the second cable.

5. The connector of claim 1 further comprising:

a rib attached to the interior of the receiver wherein the rib extends outward with respect to the interior of the receiver.

6. The connector of claim 1 further comprising:

a groove on the exterior surface of the receiver wherein the groove extends inward with respect to the exterior surface of the receiver.

7. The connector of claim 1 further comprising:

a groove on the exterior surface of the base wherein the groove extends inward with respect to the exterior surface of the base.

8. A system for connecting a first cable to a second cable, the system comprising:

a finger having an exterior surface and a length wherein the length is defined between a first end and a second end wherein the first end has a finger base wherein the finger base is attached to an end of the first cable wherein the exterior surface of the finger has a recession wherein the recession extends longitudinally along the exterior surface of the finger from the finger base to the second end of the finger;

a projection connected to the finger within the recession wherein the projection extends from the recession outward with respect to the exterior surface of the finger wherein the projection is electrically connected to the first cable;

a base having an interior and an exterior surface wherein the base has a length wherein the length is defined between a first end and a second end wherein the second end of the base is attached to an end of the second cable; and a receptor electrically connected to the second cable wherein the receptor is insertable into the interior of the base wherein the interior of the base receives the finger wherein the projection abuts the receptor wherein the finger rotates with respect to the base and further wherein the receptor is electrically connected to the projection.

9. The system of claim 8 wherein the first end of the base is a clip.

10. The system of claim 8 wherein the first cable is electrically connected to the second cable.

11. The system of claim 8 further comprising:

a compartment is inserted between the receptor and the base wherein the receptor is attached to the compartment.

12. The system of claim 8 further comprising:

an opening in the base extending through the base from the interior to the exterior surface.

13. The system of claim 8 further comprising:

a groove on the exterior surface of the finger base extending inward with respect to the exterior surface of the finger base.

14. A method for connecting a first cable to a second cable wherein an end of the first cable is adjacent to an end of the second cable, the method comprising the steps of:

providing a finger having an exterior surface and a length wherein the length is defined between a first end and a second end wherein the first end has a base wherein the base has an exterior surface and further wherein the exterior surface of the finger has a recession wherein the recession extends longitudinally along the exterior surface of the finger from the base to the second end of the finger wherein the finger has a projection extending outward with respect to exterior surface of the finger;

providing a receiver having an interior, an exterior surface and a length wherein the length is defined between a first end and a second end;

connecting a receptor to the interior of the receiver;

inserting the finger into the interior of the receiver; and rotating the finger with respect to the receiver wherein the projection is electrically connected to the receiver.

15. The method of claim 14 further comprising the step of:

electrically connecting the projection or the receptor to the first cable or the second cable.

16. The method of claim 14 wherein the first cable is electrically connected to the second cable.

17. The method of claim 14 further comprising the step of:

inserting the receiver into a base attached to the second cable.

18. The method of claim 14 further comprising the step of:

transmitting an electrical signal between the projection and the receptor.

19. The method of claim 14 further comprising the step of:

forming a groove on the exterior surface of the base wherein the groove extends inward with respect to the exterior of the base.

20. The method of claim 14 further comprising the step of:

rotating the end of the second cable with respect to the end of the first cable.

* * * * *